US007026586B2

(12) United States Patent
Oyumi

(10) Patent No.: US 7,026,586 B2
(45) **Date of Patent: *Apr. 11, 2006**

(54) INDUCTION HEATING APPARATUS WITH CURRENT MODULATING MEANS

(75) Inventor: Masashi Oyumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/071,328

(22) Filed: Mar. 4, 2005

(65) Prior Publication Data

US 2005/0145619 A1 Jul. 7, 2005

Related U.S. Application Data

(62) Division of application No. 10/268,935, filed on Oct. 11, 2002, now Pat. No. 6,878,908.

(30) Foreign Application Priority Data

Oct. 15, 2001 (JP) ..... 2001/317260

(51) Int. Cl.
*H05B 6/14* (2006.01)
*G03G 15/20* (2006.01)

(52) U.S. Cl. ..... 219/619; 219/661; 399/328

(58) Field of Classification Search ..... 219/619, 219/634, 660–666, 670, 668; 399/328–338
See application file for complete search history.

(56) References Cited

U.S. PATENT DOCUMENTS

| | | | | |
|---|---|---|---|---|
| 4,165,964 | A | 8/1979 | Bernardelli et al. | 432/75 |
| 4,348,579 | A | 9/1982 | Namba | 219/216 |
| 4,355,578 | A | 10/1982 | Raquet | 104/1 A |
| 5,752,150 | A | 5/1998 | Kato et al. | 399/330 |
| 5,763,859 | A | 6/1998 | Wirz et al. | 219/619 |
| 6,122,477 | A | 9/2000 | Parker | 399/330 |
| 6,385,406 | B1 | 5/2002 | Funamizu et al. | 399/16 |
| 6,441,353 | B1 | 8/2002 | Gehrmann et al. | 219/619 |
| 6,601,472 | B1 | 8/2003 | Baron | 74/574 |
| 6,878,908 | B1 * | 4/2005 | Oyumi | 219/619 |
| 2002/0030050 | A1 | 3/2002 | Takagi et al. | 219/619 |

FOREIGN PATENT DOCUMENTS

| | | |
|---|---|---|
| JP | 4-220991 | 8/1992 |
| JP | 9-80951 | 3/1997 |
| JP | 2000-357581 | 12/2000 |
| WO | WO 00/19586 | 4/2000 |
| WO | WO 01/48562 A1 | 7/2001 |

* cited by examiner

*Primary Examiner*—Philip H. Leung
(74) *Attorney, Agent, or Firm*—Fitzpatrick, Cella, Harper & Scinto

(57) ABSTRACT

A fixing apparatus has an excitation coil disposed adjacent the heating element; a voltage source for applying to the excitation coil a high frequency electric power provided by modulating an input AC electric power with a high frequency, wherein the heating element is heated by induction by the excitation coil supplied with the high frequency electric power, wherein the heating element has a characteristic frequency which is unequal to integer multiple s of a frequency of the AC electric power.

9 Claims, 9 Drawing Sheets

INDUCTION HEATING APPARATUS WITH CURRENT MODULATING MEANS

This is a divisional application of U.S. patent application Ser. No. 10/268,935, filed on Oct. 11, 2002 now U.S. Pat. No. 6,879,908, and allowed on Nov. 24, 2004.

FIELD OF THE INVENTION AND RELATED ART

The present invention relates to a heating apparatus using induction heating as a heat generation source, and an image forming apparatus using the heating apparatus to heat and fix on a recording paper a toner image formed on a recording material with heat-fusing toner as a developer.

An image forming apparatus such as an electrophotographic apparatus comprises image forming means (unshown) for forming a toner image on a recording paper with a developer (toner). The recording paper on which the toner image is formed is fed by paper feeding means (unshown) to a fixing device 801 shown in FIG. 10 in an image forming apparatus indicated by an arrow in the Figure, so that toner image 811 is heated, pressed and fixed on the recording paper 810.

In the fixing device 801, a halogen heater 804 is disposed in a heating roller 802 (as an addition heat source) which is press-contacted to the pressing roller 803, and the pressing roller 803 and the heating roller 802 are rotated in the direction indicated by an arrow by unshown driving source. In a widely used temperature adjustment method, a temperature sensor 805 is provided to detect a temperature, in response to which a halogen heater 804 is ON/OFF controlled such that surface of the heating roller is maintained at a predetermined temperature.

FIG. 11 shows an ON/OFF control circuit for the halogen heater 804, in which 802 designates a heating roller; 804 is a halogen heater; 905 is a thermister (temperature sensor); 901 is a sequence controller; 902 is a SSR (solid state relay); 903 is an AC voltage source; 904 is a comparator; and 906 is a reference resistance. The resistance value of the thermister 805 decreases with increase of a temperature. Therefore, a voltage (thermister detected voltage) between thermister and GND (ground), divided out by a reference resistance, decreases with increase of the temperature. Comparison is made between t reference voltage Vr set at a temperature control target temperature and a thermister detected voltage, and when the thermister detected voltage is higher than the reference voltage Vr, an ON signal is supplied to the SSR902 from the comparator 904.

The output of the SSR902 is ON when the output of the comparator 904 is ON, that is, when the inputted control signal is at H level, it is ON, and when the inputted control signal is at L level, it is OFF. When the output of SSR902 is ON, an AC current supplied by the AC voltage applied by the AC voltage source 903 is applied through the halogen heater 804 by which the temperature of the heating roller 802 rises. When the roller surface temperature reaches the temperature control target temperature, and therefore, the thermister detected voltage becomes lower than t reference voltage Vr, the output of the comparator 904 renders OFF the SSR 902. By such ON-OFF control, the heating roller surface temperature is maintained at the target temperature. In an alternative, the sequence controller is provided with an A/D (analog/digital) converter which functions to digitize the thermister detected voltage. The digitalized data are compared with the reference value by software, and an ON-OFF control is effected.

A heating apparatus has been proposed in which as means for heating the heating roller 802, the use is made with an excitation coil (unshown) disposed adjacent the heating heat roller 802. A high frequency current is applied through the excitation coil to generate a high frequency magnetic field in the heating roller surface layer, so that eddy currents are produced in the electroconductive layer at the surface of the heating roller to generate joule heat, which is used to heat the heating roller 802 (induction heating type).

With such a heating apparatus of an induction heating type, the heating roller per se can be heated, and the electric power effective for the heating is controllable, and therefore, the target temperature can be quickly reached.

In a conventional system in which a halogen heater is rendered ON and OFF to control the heating roller temperature, the electric power usable for heating the heating roller is at most a consumption power of the halogen heater. The maximum consumption electric power is set to be within a predetermined range. Therefore, during the warming-up period immediately after the voltage source actuation in which the temperature of the heating roller is sufficiently lower than the operable temperature, the usable electric power is at most the electric energy consumption of the halogen heater, with the result that time period required for the fixable temperature to be reached is relatively long.

In an induction heating type in which the electric power supply for the heating is variable, the electric power inputted from a commercial voltage source is applied to an excitation coil with switching at a predetermined high frequency, and the current induced by the high frequency electric power flows through the heating roller per se.

FIG. 12 is a schematic diagram of the induction heating type system. The high frequency current Ip applied to the excitation coil corresponds to the frequency of the high frequency switching, but the average current Iav flowing through the excitation coil corresponds to twice the frequency of the frequency fp of the commercial voltage source (electric energy). The frequency of the commercial voltage source fp is a reciprocal of the cyclic period thereof. By doing so, between the heating roller and the excitation coil, a force corresponding to twice frequency of the frequency fp of the commercial voltage source. Here, the frequency fp of the commercial voltage source is generally 50 Hz or 60 Hz, and the twice frequency is 100 Hz or 120 Hz. The force is such that heating roller rotatably mounted on the heating apparatus is attracted or repelled relative to the excitation coil fixed to the heating apparatus. Particularly when the frequency of the applied force (or an integer multiple thereof) is the same as a characteristic frequency fn of the heating roller, there is a liability that resonance vibration of the heating roller occurs with the result of very large vibration or noise.

SUMMARY OF THE INVENTION

Accordingly, it is a principal object of the present invention to provide a device wherein the resonance of the heating element due to the voltage source frequency of the AC power source is prevented, so that vibration or noise is prevented.

According to an aspect of the present invention, there is provided a heating element includes an excitation coil disposed adjacent the heating element; a voltage source for applying to the excitation coil a high frequency electric power provided by modulating an input AC electric power with a high frequency, wherein the heating element is heated by induction by the excitation coil supplied with the high frequency electric power, wherein the heating element has a characteristic frequency which is unequal to integer multiples of a frequency of the the AC electric power.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

The description will be made as to the preferred embodiments of the present invention.

Embodiment 1

Figure 2:
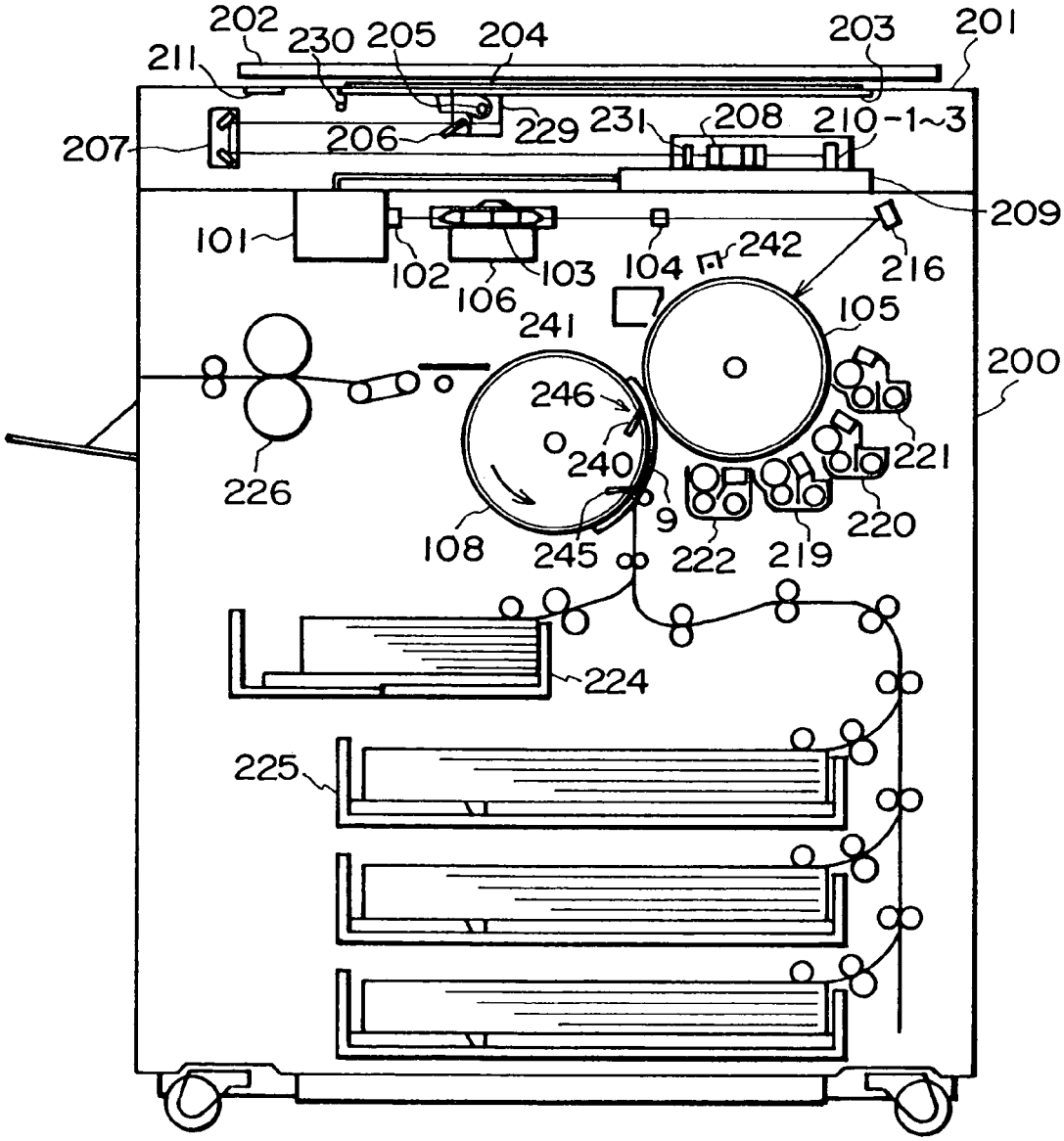
FIG. 2 illustrates a general arrangement of an image forming apparatus.

FIG. 2 is a schematic view of a color image forming apparatus using a heat-fixing device having the heating apparatus according to this embodiment as the heat source, wherein designated by 201 is an image scanner portion, which reads an original and converts the image thereof to digital signals. Designated by 200 in addition a printer station which functions to effect full-color print corresponding to image data from an external device such as the image scanner 201, a computer or the like.

The image scanner portion 201 comprises an original pressure plate 202 which is effective to press the original 204 on t original supporting platen glass 203. The original 204 on the original supporting platen glass 203 is illuminated by halogen lamp 205. Light reflected by the reflected light is directed to mirrors 206, 207, and is imaged on a 3 line sensor (CCD) 210-1-210-3 by a lens 208. The lens 208 is provided with a far-infrared cutting filter 231.

The CCD s 200-1-210-3 color-separate the light information from t original and reads full-color information (red (R), green (G) and blue (B) components) and supplies output to a signal processing portion 209. The halogen lamp 205, the mirror 206 mechanical moves at a speed V, and the mirror 207 moves at a speed ½V, in a perpendicular direction ((sub-scan direction) relative to an electrical scanning direction (main scan direction) of the CCD sensors 210-1-210-3 to scan the whole surface of the original.

Designated by 211 is a standard white color plate, which is used to generate correction data for correcting the data provided by the reading. The standard white color plate 211 has a substantially exhibits a substantially uniform reflection particularly property in a range from the visual light to the infrared light, and is white in the visual range. Using the standard white color plate 211, the output data of the visual sensor of the CCD sensors 210-1-210-3 is corrected (shading). Designated by 230 is a photo-sensor, which cooperates with a flag plate 229 to generate an image top signal VTOP.

Figure 4:
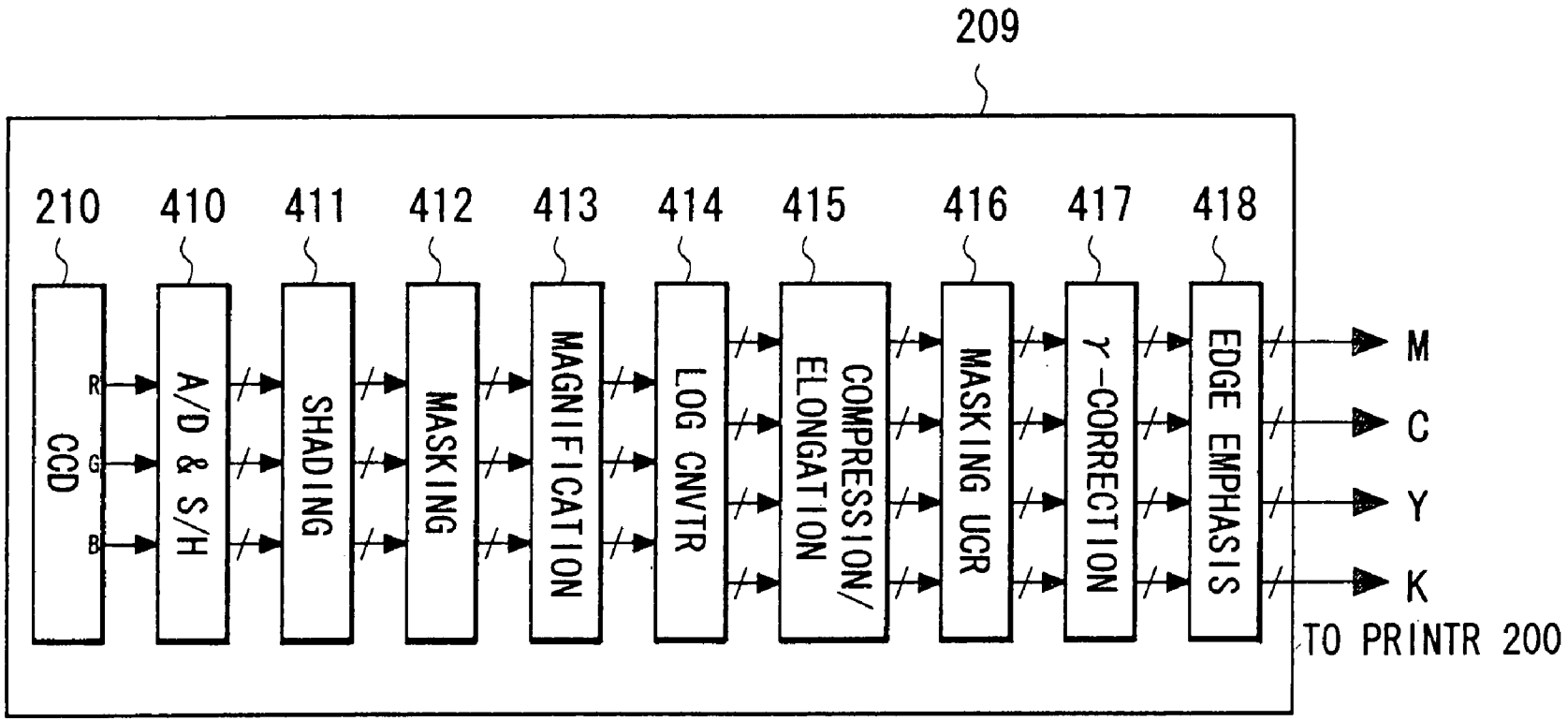
FIG. 4 is a block diagram showing flows of image processor in the image forming apparatus.

The image signal (electric signal) is processed in the image processor 209 in accordance with the flow shown in FIG. 4. The signals from the CCD sensors 210-1-210-3 are converted to digital data in A/D & S/H portion 410, the image data is corrected by the shading correction portion 411 and the input masking portion 412. During variable magnifying operation, the variable magnification process is carried out in the variable magnification processing portion 413.

Subsequently, a LOG conversion portion 414 converts the RGB data to magenta (M), cyan (C) and yellow data, which are inputted to a compressing and elongating portion 415 for compressing, storing and elongating the image data. The stored image data is read out in synchronism with the respective color printing portions of a printer which will be described hereinafter. After the image data are subjected to a masking process by a masking-UCR portion 416, they are further corrected by a &c&correction portion 417 and an edge stressing portion 418 to generate M, C, Y and black (K) output image data. Then, they are fed to a printer station 200. Here, for original scanning by the image scanner portion 201, one of M, C, Y, K components is fed to the printer station 200. By four original scanning operations, one print is produced.

The description will be made as to an operation of the printer station 200. The image signal from an external device such as a scanner portion 201 or an unshown computer or the like, is fed to an image writing timing control circuit 101. The image writing timing control circuit 101 modulates and actuates the semiconductor laser 102 in response to a magenta (M), cyan (C), yellow (Y) and black (K) image signal. The laser beam is reflected by a polygonal mirror 103 rotated by a polygonal motor 106, and is subjected to a fθcorrection by a f-θ lens 104. It is reflected by the folding mirror 216 to scan the photosensitive drum 105.

The photosensitive drum 105 has been uniformly charged by a primary charger 242, and therefore, an electrostatic latent image is formed on the photosensitive drum 105 by the laser exposure. Around the photosensitive member 105, there are provided magenta (M) 219, cyan (C) 220, yellow (Y) 221 and black (K) 222 developing devices. With four full-turns of the 219, cyan, the four developing devices are contacted to the circumference sequentially to develop the M, C, Y, K electrostatic latent images formed on the photosensitive drum 105 with the corresponding toner particles.

On the other hand, the recording paper fed from recording paper sheet feeders 224, 225 is electrostatically attracted on a transfer drum 108 having been electrically charged in a sheet attracting polarity by an attraction charging blade 245 connected with an unshown attraction high voltage generating portion, at timing in synchronism with the image formation on the photosensitive drum.

It is pushed up toward the photosensitive drum 105 by a transfer charging blade 240 connected to an unshown transfer high voltage generating portion at a transfer position 246, so that toner is transferred onto the transfer material. The image formation and transferring operations are repeated four times, and thereafter, the recording paper is separated from the transfer drum 108, and is fed to a fixing device 226 (fixing means) which heat-fixes the toner image on the recording paper. Then, the recording material in addition discharged as a print. The cleaner 241 functions to remove from the photosensitive drum the residual toner which has not been transferred and toner of specified patch (for various controls) which has been formed on the photosensitive drum 105 but is not to be transferred onto the transfer material.

Figure 7:
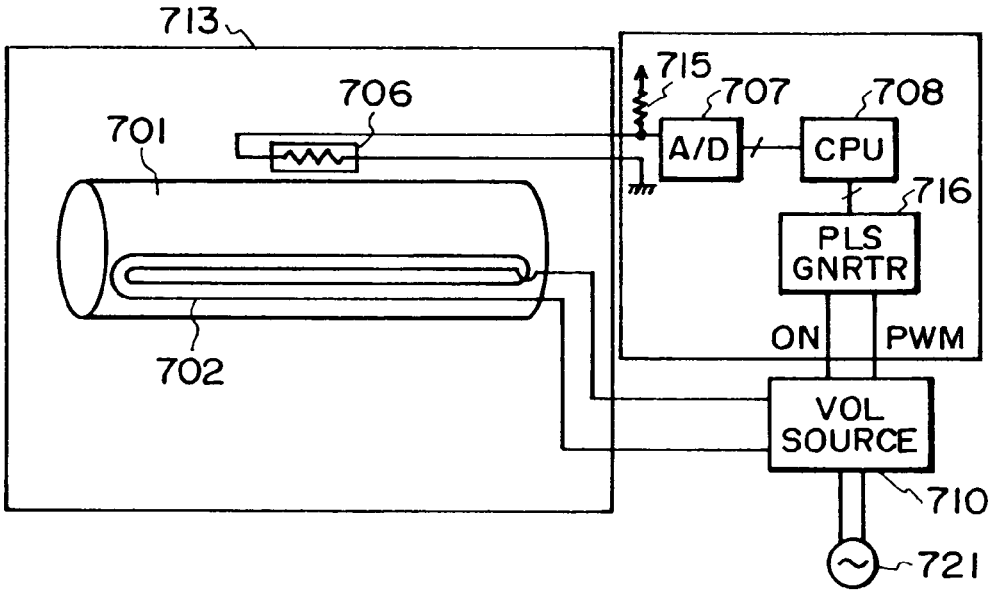
FIG. 7 illustrates a heating and fixing controller according to an embodiment of the present invention.

FIG. 7 shows a heating apparatus of this embodiment. Designated by 701 is a heating roller; 702 is an excitation coil; 706 is a thermister; 707 is an A/D convertor; 708 is a CPU; 710 is an induction heating voltage source for supplying high frequency electric power to the excitation coil 702; 713 is a fixing device; 715 is a reference resistor; 716 is a pulse generator; 721 is an AC voltage source.

Figure 6:
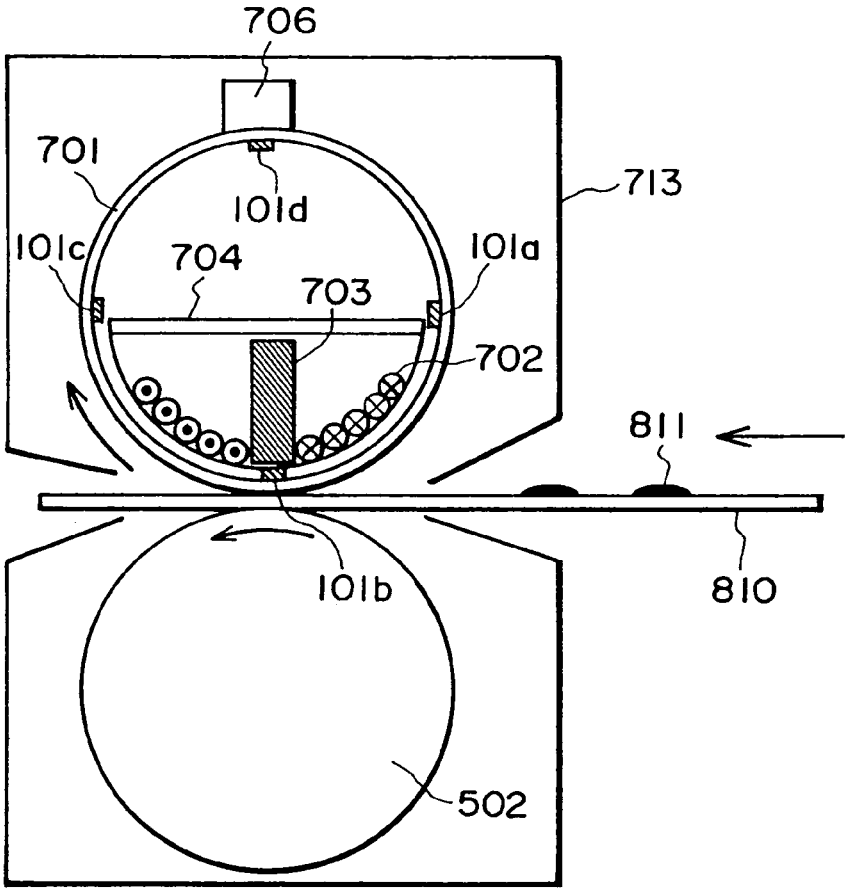
FIG. 6 illustrates an illustration of a heat-fixing device according to an embodiment of the present invention.

The CPU708 is connected by bus lines with the A/D converter 707 and the pulse generator 716, and effects sequence control in accordance with a program stored in an unshown ROM connected in the same bus. The excitation coil 702 is an induction heating coil which generates a high frequency magnetic field by application of a high frequency current. It is magnetically connected with a core (I core) 703 having an I-shaped section disposed as shown in FIG. 6. The generated high frequency magnetic field is connected with the heating roller 701 to constitute a magnetic circuit.

FIG. 6 is a view of a heat-fixing device using the heating apparatus 713 according to an embodiment of the present invention. The heating roller 701 which is a heating roller 701 is a hollow pipe roller of steel, and is rotatably mounted on a fixing device frame and is rotated by an unshown driving means. On an inside wall of the roller, rib members 101*a*–101*d* (reinforcing member) for changing the characteristic frequency are provided. In the shown example, the rib members 101*a*–101*d* are mounted on the inner wall at respective four positions. The rib member 101*a*–101*s* d are made of non-magnetic material so as not to be influential to the magnetic circuit.

The magnetic circuit generating structure constituted by the excitation coil 702 and the I core 703 is disposed in the heating roller and is supported by the supporting member 704, and the magnetic field generated by the excitation coil 702 is imparted in the surface of the heating roller. The supporting member 704 is made of a non-magnetic material such as a heat resistive resin material, and is fixed on a frame of the heating apparatus at the opposite ends thereof.

The excitation coil 702 and the I core 703 extend in the longitudinal direction of the heating roller 701, and encloses the I core 703. In FIG. 6, through the wire portions indicated by circles with dots, the current flows in the same direction, and through the wire portions indicated by circles with x, the current flow in the same direction, which however is opposite from the direction of the wire portions indicated by circles with dots. I core 703 comprises a ferrite having a high magnetic permeability. Designated by 502 is a pressing roller, and is urged to the heating roller 701. A recording paper 810 carrying a toner image 811 is passed through between the pressing roller 502 and the heating roller 701 driven by an unshown driving source, by which the toner image is heat-fixed on the recording paper.

Figure 1:
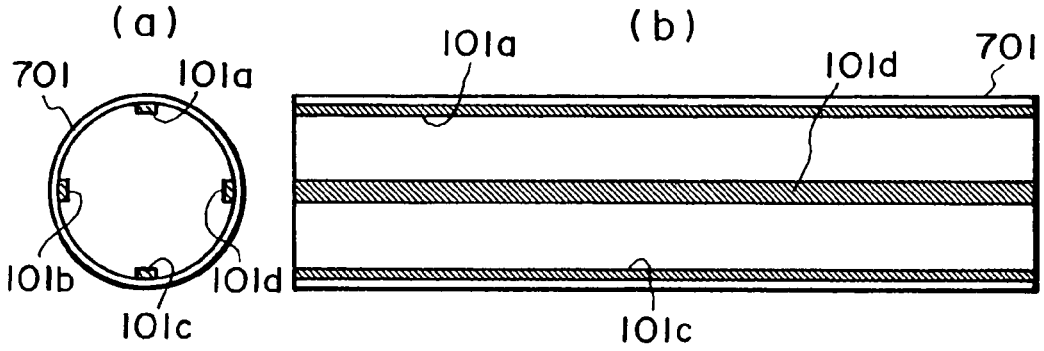
FIG. 1 illustrates a structure of a heating roller.

FIG. 1, (a) is a sectional view of the heating roller 701 having an inner wall on which rib members 101*a*–101*d* are provided. As shown in FIG. 1, (b), the rib members 101*a*–101*d* are elongated in t longitudinal direction of the roller. The rib members 101*a*–101*d* are effective to change the characteristic frequency of the heating roller 701 determined by the elasticity thereof. By properly selecting the number and width of the rib members 101*a*–101*d*, the characteristic frequency of the heating roller 701 is selectable. When the characteristic frequency of the heating roller is selected, it is preferable that frequency is not equal to an integer multiple of the frequency of the AC electric power source. Particularly, it is desirably not equal to even number multiple. Further particularly, the frequency which is twice the frequency of the power source is greatly influential to the force imparted to the heating roller, and it is particularly desirable that the frequency is not equal to twice the frequency of the power source. The characteristic frequency of the heating roller is measured by mounting an acceleration sensor to the heating roller and detecting a frequency of vibration caused by lightly hammering the heating roller.

The operation of the device according to this embodiment will be described. In FIG. 7, AC electric power is supplied from the AC voltage source 721 to the induction heating voltage source 710. When an ON signal and a PWM signal are fed to t induction heating voltage source 710 through the pulse generator 716 from the CPU70S ruling the sequence control, high frequency AC electric power is generated in response to the PWM signal at an output terminal of the induction heating voltage source 710 connected to the excitation coil 702.

Figure 3:
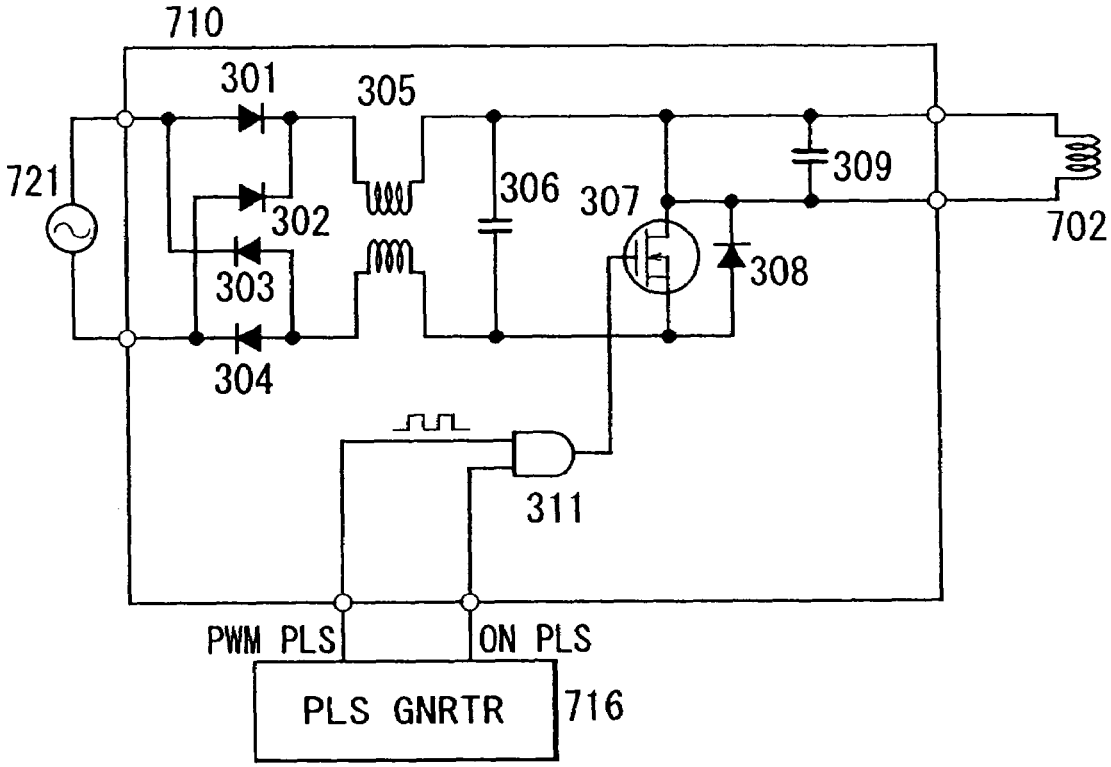
FIG. 3 is a block diagram of an induction heating voltage source.

FIG. 3 is a detailed block diagram of the induction heating voltage source 710. Designated by 301–304 are diodes; 305 is a reactor for a noise filter; 306 is a capacitor for the noise filter; 307 is an electric power switching MOS-FET; 308 is a diode; 309 is a capacitor 311 is a logical product (AND) gate; 721 is an AC voltage source (commercial power source) for energizing the induction heating voltage source; 702 is an excitation coil which is supplied with an output from the induction heating voltage source 710; 716 is a pulse generator connected so as to control the induction heating voltage source 710.

The AC current applied from the AC voltage source 721 is converted to a pulsating flow rectified by the diodes 301–304, and the waveform thereof is rectified by passing through the coil 305 and the capacitor 306 which constitute a noise filter. The parameters of the coil 305 and the capacitor 306 constituting the noise filter are set such that sufficient attenuation amount is assured for the switching frequency of the MOS-FET307 and that no attenuation of passage is assured for the voltage source frequency fp of the AC voltage source 721.

From t pulse generator 716, a PWM signal and an ON signal of a predetermined pulse width is fed to t induction heating voltage source 710. When t ON signal is at a H level, the PWM signal is applied across the source and the gate of the MOS-FET 307 through the AND gate 311, and the MOS-FET 307 becomes conductive during the H level section of the PWM signal, so that rectified inputting current is drain current to energize the excitation coil 702.

When the MOS-FET 307 becomes open in the L level section of the PWM signal, a back electromotive force is generated by the excitation coil 702 accumulating the current flowing when the MOS-FET 307 is ON, and the back electromotive force is charged in the resonance capacitor 309 connected in parallel with the excitation coil 702. By the coil accumulating current, the voltage across the resonance capacitor 309 increases, and a maximum AC voltage is generated when the accumulation energy of the excitation coil 702 becomes zero.

The current flown out of the excitation coil 702 attenuates in inverse proportion to the increase of the voltage, at a certain instance, no coil current flows, and after that, the charge accumulated in the resonance capacitor 309 flows out to the excitation coil 702 and produces a current thereby.

Simultaneously with the charge accumulated in the resonance capacitor 309 returns to t excitation coil 702, the voltage of the resonance capacitor 300 decreases. When the drain voltage of the MOS-FET 307 lowers beyond the source voltage, a flywheel diode 308 is rendered ON so that forward current flows. Then, the MOS-FET 307 is reactuated so that current flows through the excitation coil 702, so that AC current of the frequency corresponding to the PWM signal continues to flow through the excitation coil 702.

Figure 5:
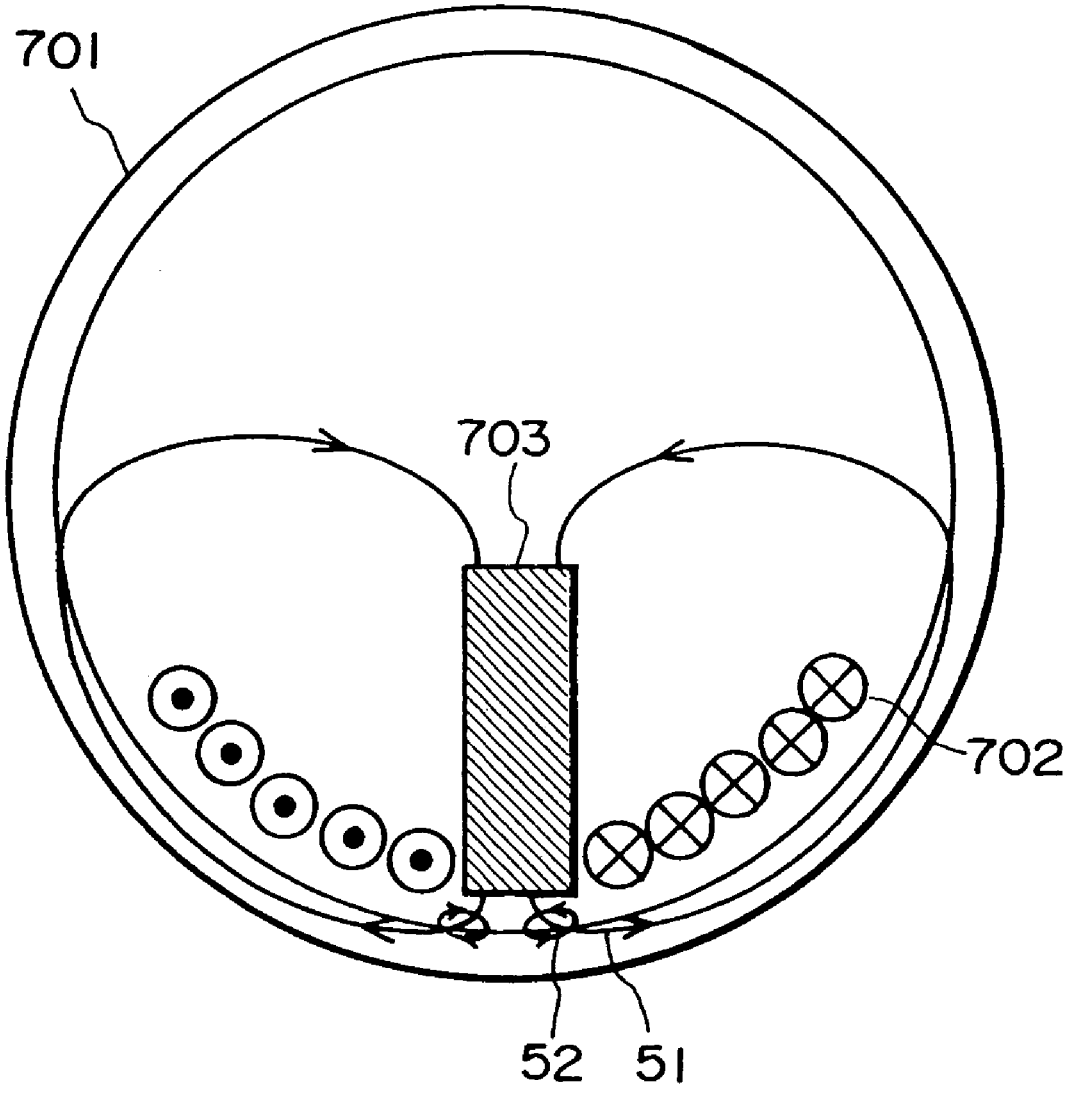
FIG. 5 is an illustration of a magnetic circuit used in the present invention.

By the AC electric power of the predetermined frequency from t induction heating voltage source 710 being applied across t excitation coil 702, the excitation coil 702 generates an AC magnetic field 5. FIG. 5 shows this. The AC electric power supplied to the excitation coil 702 increases with decrease of the frequency of the AC electric power applied to the excitation coil 702, and it is normally 200 W to several kW approx.

The eddy currents 52 are generated in the surface of the heating roller 701 to which the AC magnetic field 51 produced by the AC electric power is opposed. By t eddy currents 52 flowing in the surface of the heating roller, joule heat is produced in the surface of the heating roller leaving due to the resistivity of the heating roller 701, that is, the surface of the heating roller generates heat by itself. At this time, the magnetic field is concentrated at the I core 703 having a high magnetic permeability, by which a large amount of the heat is generated by the eddy currents at a portion of the heating roller 701 opposed to the I core 703. The larger the electric power supplied to the excitation coil 702, the larger the amounts of the generated AC magnetic field and Joule heat.

By the heat generation of the surface of the heating roller thus provided, the resistance value of the thermister 706 disposed on t surface of the heating roller decreases with the increase of the temperature. As shown in FIG. 7, a voltage (detected thermister voltage) between the thermister and GND divided out with the aid of the reference resistance disposed substantially at a longitudinal center of the heating roller 701 decreases with increase of the temperature. The detected thermister voltage is digitalized by an A/D converter 707 and is supplied to t CPU708, where the digitalized data is software compared with the reference temperature, and a set point for determining ON/OFF pulse width of the PWM signal to t induction heating voltage source 710 is outputted to t pulse generator 716.

Figure 13:
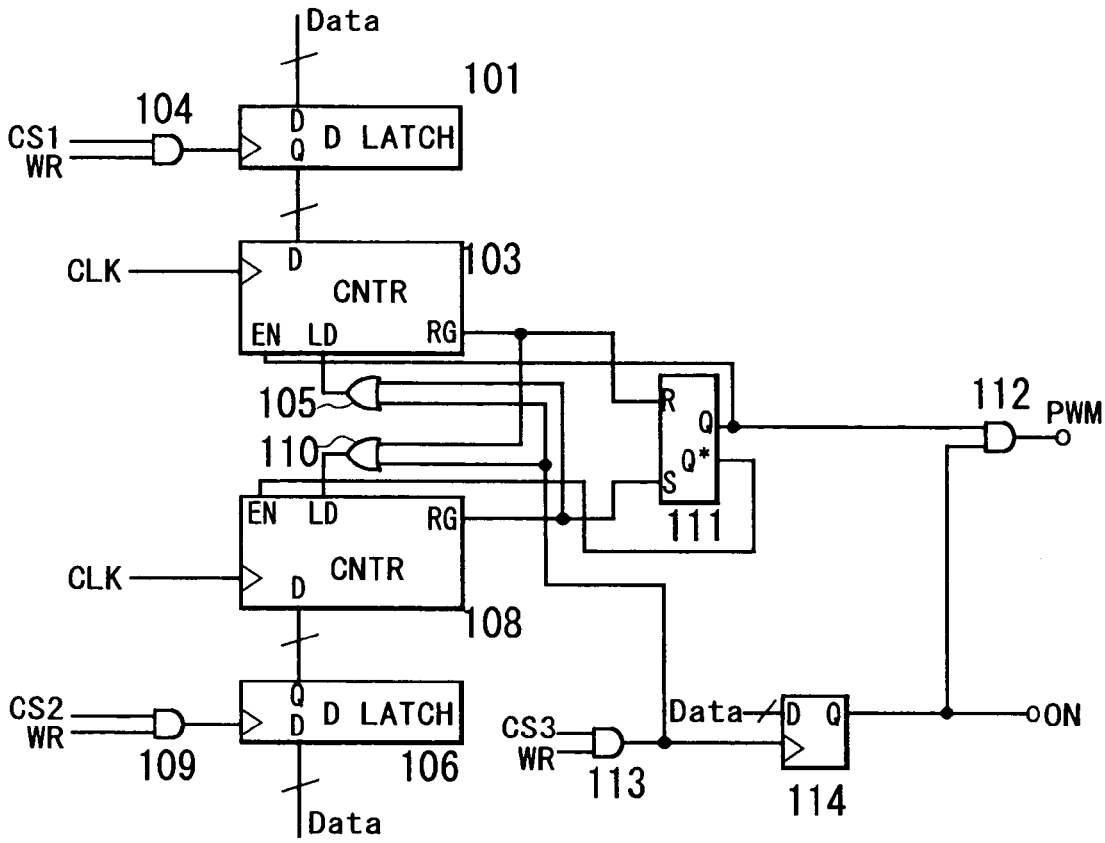
FIG. 13 is a block diagram of a control system.

The pulse generating portion 716 compares the CLK signal with the set point provided by the CPU708 and the predetermined set point, and counts with a proper set value, to produce a PWM signal of proper ON and OFF widths. FIG. 13 is a block diagram showing details of the pulse generator 716, wherein designated by b101, 106 and 114 are D latches; 103 and 108 are down counters; 104, 109, 112 and 113 are logical product (AND) gates; 105 and 110 are logical sum (OR) gate; 111 is a SR latch.

Figure 8:
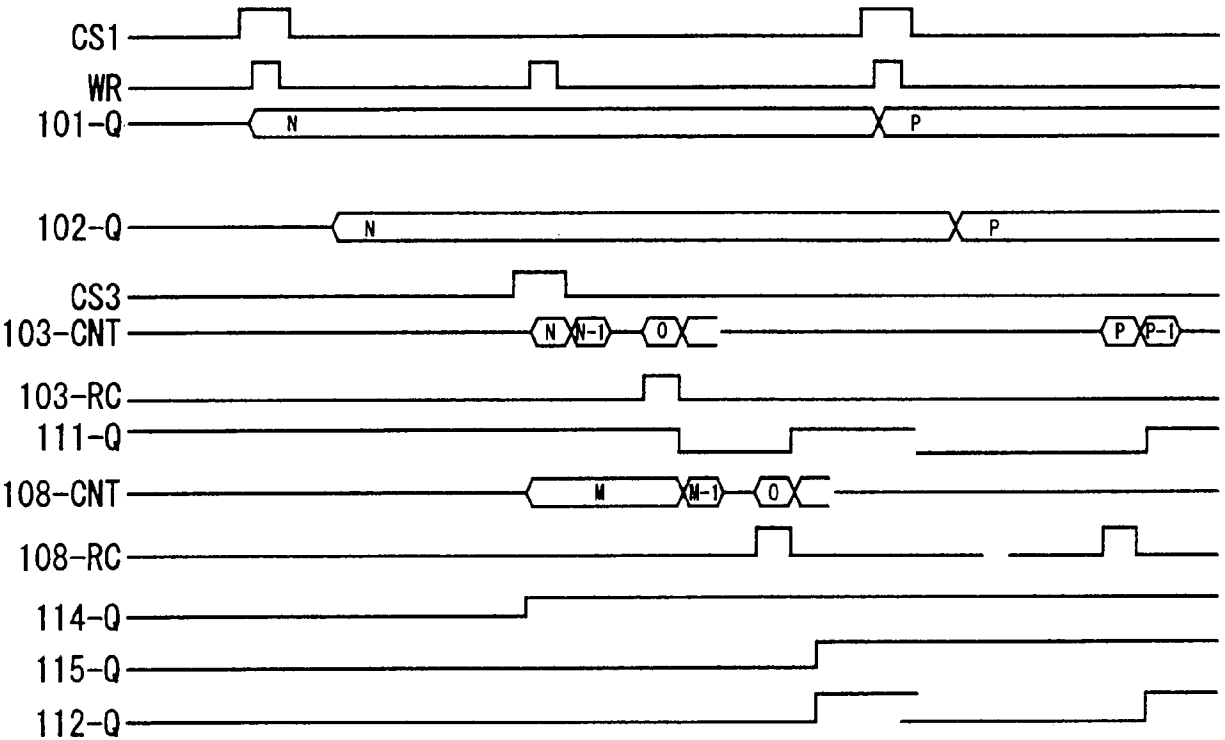
FIG. 8 is a timing chart of a pulse generating portion according to an embodiment of the present invention.

The PWM generation timing chart will be described with respect to the operation of the pulse generator shown in FIG. 8. Here, designated by CS1-3 is a selection signal of a register, and WR is a light signal. CS1-3. Data, WR, CLK is included in the bus between the CPU708 and the pulse generator 716. Designated by 101-Q is a Q output of the D latch 101; 102-Q is a Q output of the D latch 102; 103-CNT is a count of the counter 103; 103-RC is a ripple-output of the counter 103; 111-Q is a Q output of the DSR latch 111; 108-CNT is a count of the counter 108; 108-RC is a ripple-output of the counter 108; 114-Q is a Q output of the D latch 104; 115-Q is an output of the and gate 115; and 112-Q is an output of the logical product (AND) gate 112.

CLK is a signal having a frequency of several MHz, and is inputted to each D latch and counter as reference signals, and PWM pulses of approx. 20 kHz–100 MHz using counts of the signals. The data=N outputted to the Data path at the time when the selection signal CS1 is selected with H level, and the light signal WR rises. Are latched on the D latch 10. The register CS8 is selected with H level indicative of the driving voltage source being ON, and data=1 is latched by the D latch 114 at the rising of the light signal WR, and the data=N is loaded in the counter 103.

Since the enablement EN of the counter 103 connected to the Q output of the SR latch 111 is at the H level, the counter 103 carries out the down count operations in accordance with the CLK. When the count becomes 0, it makes the ripple carrying signal RC=H. By this output, the SR latch 111 is reset, Q=L level and Q*=H level result, and in addition, count=M is loaded into one 108 of the counters. The operations of the D latch 106 are the same as the D latch 101.

The counter 108 is by the loading of the count=M carries out downcounting operation in accordance with the CLK, and when count=0, the ripple carrying signal RC becomes H. By this output, the SR latch 111 is set, and Q=H level and Q*=L level result. By repeating this, the PWM pulses having ON width=N and OFF width=M count are generated as an output of the SR latch 111.

The PWM signal and the ON signal are fed to t induction heating voltage source, a high frequency AC electric power of approx. 20 kHz–100 kHz (converted so as to correspond to the PWM signal) at the output terminal of the induction heating voltage source 710. By such operations, the temperature of the surface of the heating roller can be maintained at the predetermined temperature. Here, the characteristic frequency of the heating roller 701 is selected so as not to be equal to the frequency fp or an integer multiple of the commercial electric power, and therefore, great vibration or noise due to resonance of the heating roller 701 can be prevented.

Embodiment 2

In order to deviate the characteristic frequency of the heating roller 701 from the integer multiple of the frequency fp of the commercial power source, the thickness of the heating roller 701 may be changed, thus changing the elasticity of the heating roller per se by which the characteristic frequency of t heating roller 701 is changed. When t induction heating type heating roller 701 is made of steel, the proper thickness is 0, 3 mm–1.0 mm degree. In this range, the characteristic frequency fn of the heating roller 701 can be deviated from integer multiples of the frequency of the commercial power source by changing the thickness of the heating roller 701 while maintaining the fixing property of the apparatus.

Embodiment 3

In order to deviate the characteristic frequency fn of the heating roller 701, the material of the heating roller 701 may be changed so that elasticity of the heating roller per se is changed by which the characteristic frequency fn of the heating roller 701 is changed. For example, when the steel is used as a core metal of the heating roller 701, the mechanical properties such as tensile strength or Young's modulus of a steel tube may be changed by changing the content or contents of the chromium, molybdenum, the niobium, the vanadium or the tungsten. Thus, by properly selecting the steel tube, the characteristic frequency of the heating roller 701 can be deviated from integer multiples of the frequency fp of the frequency of the commercial power source.

Embodiment 4

In order to deviate the characteristic frequency Fn of the heating roller 701 from the commercial electric power source, the heating roller 701 may be made of a plurality of materials, so that elasticity of the heating roller per se is changed by which the characteristic frequency of the heating roller 701 is changed. For example, the surface of the heating roller may be coated with a resin material which is selected so as to change the characteristic frequency of the heating roller 701. The coating may have a surface parting property of the entire surface of the heating roller. The coating material may be PTFE or PFA, and the thickness thereof is 10–50 μm, preferably.

Figure 9:
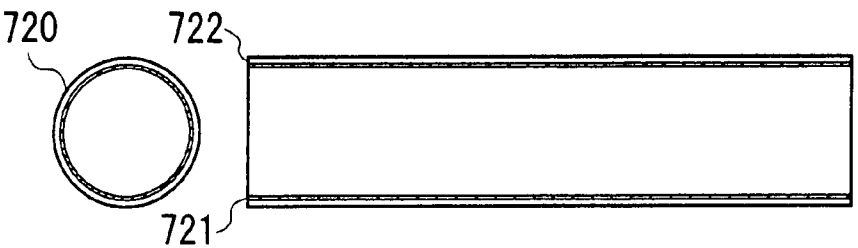
FIG. 9 shows a heating roller of a double wall structure type.
Figure 10:
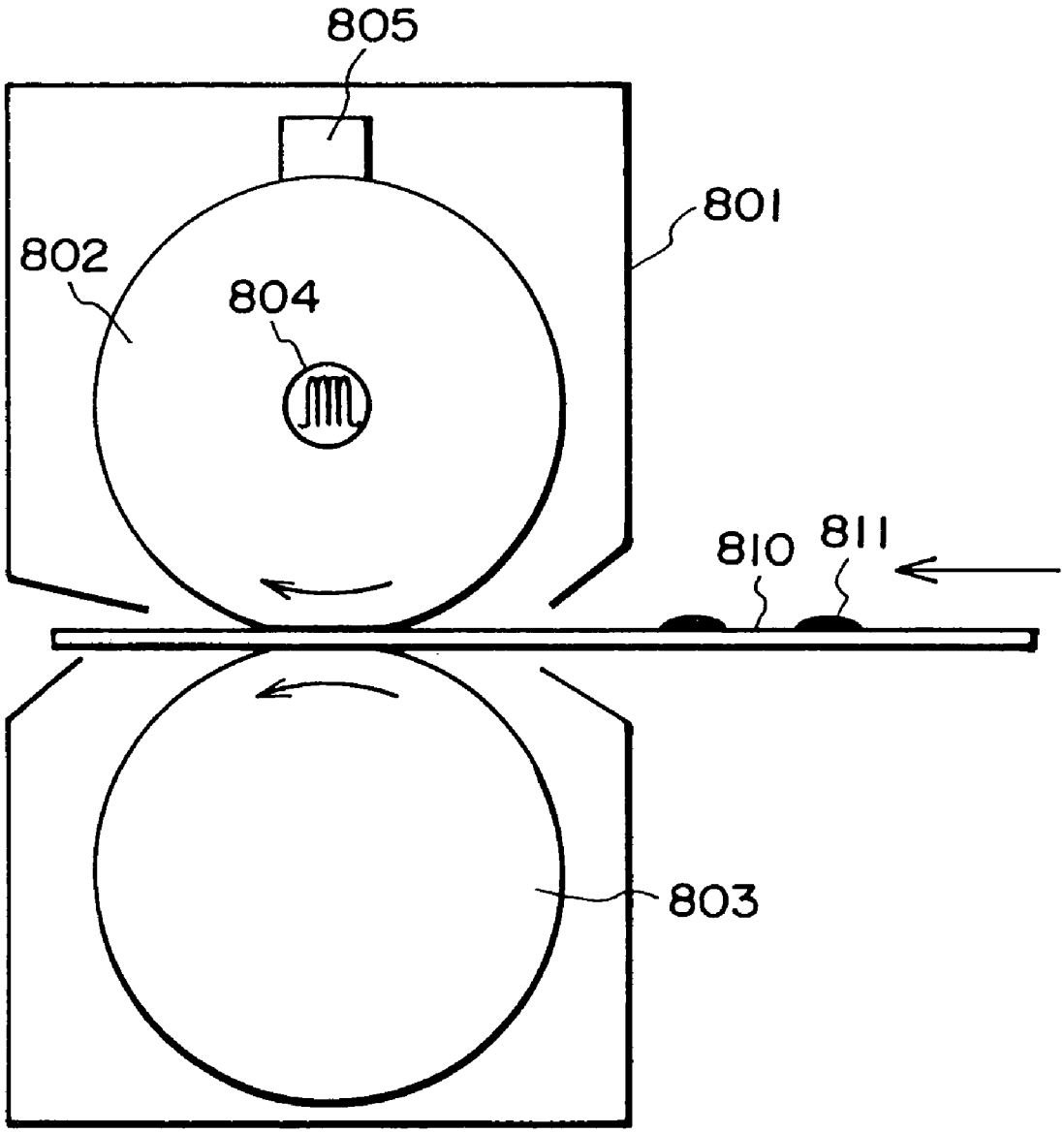
FIG. 10 is an illustration of a conventional heat-fixing device.
Figure 11:
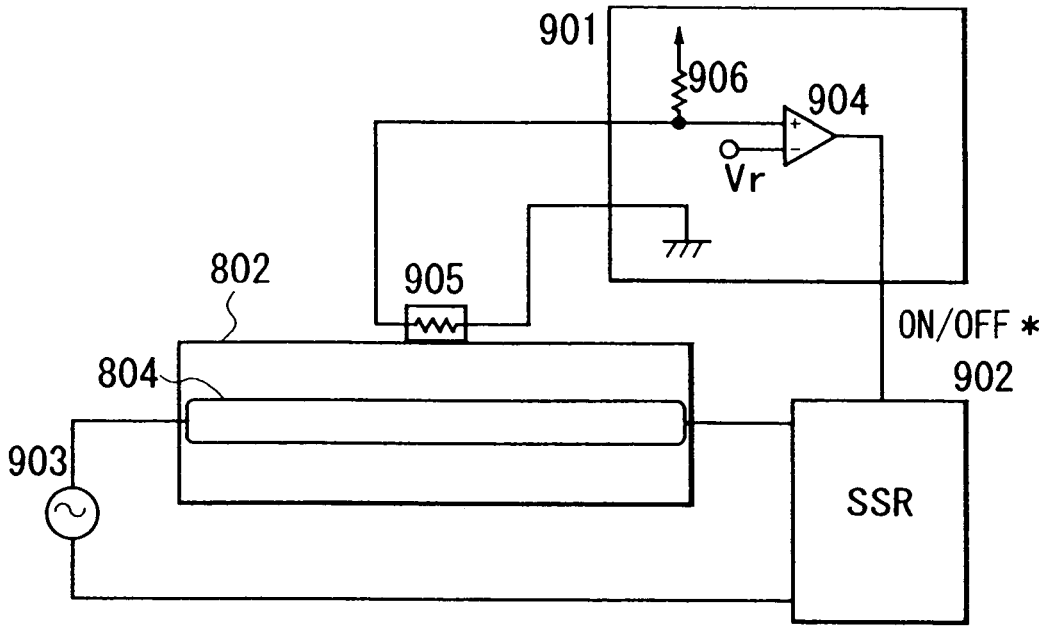
FIG. 11 is a circuit block diagram of a conventional heat-fixing device.
Figure 12:
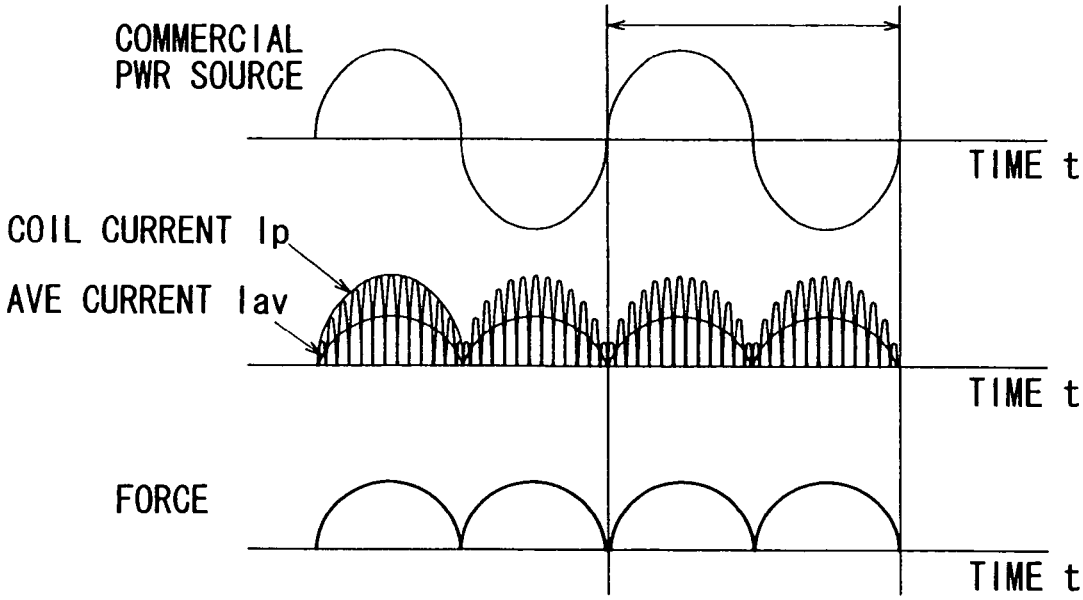
FIG. 12 is a schematic diagram explaining the commercial power source voltage, the coil current and the force applied to the roller.

Alternatively, the core metal portion of the heating roller may be made of a plurality of metal materials, so that elasticity of the heating roller per se is changed, by which the characteristic frequency Fn of the heating roller is changed. As shown in FIG. 9, the heating roller 720 may comprise a steel material 721 (constituting a part of the magnetic circuit) and an aluminum material 722 on an outer surface thereof, which are integrated with each other by interference shrink fitting. By doing so, the characteristic frequency is made different from that made of a steel only.

While the invention has been described with reference to the structures disclosed herein, it is not confined to the details set forth and this application is intended to cover such modifications or changes as may come within the purpose of the improvements or the scope of the following claims.

What is claimed is:

1. A fixing apparatus comprising:

a coil;

a heating element including a heat generating element for generating heat by a magnetic flux generated by said coil, wherein said heating element is effective to heat an image on a recording material;

modulating means for modulating a low frequency electric power supplied from a commercial power supply into a high frequency electric power of 20 kHz–100 kHz by rendering ON and OFF the low frequency electric power; and electric power supplying means for supplying the modulated high frequency electric power to said coil, wherein said heating element has a characteristic frequency which is deviated from an integer multiple of a frequency of the low frequency electric power.

2. An apparatus according to claim 1, wherein said heat generating element is in the form of a hollow roller coated with a parting layer.

3. An apparatus according to claim 2, wherein said parting layer is made of resin material.

4. An apparatus according to claim 1, wherein the frequency of the low frequency electric power is twice the frequency of the commercial power supply.

5. An apparatus according to claim 1, wherein the frequency of the commercial power supply is one of 50 Hz and 60 Hz.

6. An apparatus according to claim 1, wherein said coil is wound such that wiring thereof extends in a direction of a rotational axis of said heating element and then folded back at an end of said heating element.

7. An apparatus according to claim 1, further comprising a magnetic core for guiding the magnetic flux generated by said coil toward said heating element.

8. An apparatus according to claim 1, wherein said coil is disposed opposed to a part of a circumference of said heat generating element so as to heat a part of a circumference of said heating element.

9. An apparatus according to claim 1, wherein said coil is provided non-symmetrically with respect to a rotational axis of said heat generating member to generate heat at circumferentially a part of said heating element.

* * * * *

UNITED STATES PATENT AND TRADEMARK OFFICE

CERTIFICATE OF CORRECTION

PATENT NO. : 7,026,586 B2
APPLICATION NO. : 11/071328
DATED : April 11, 2006
INVENTOR(S) : Masashi Oyumi It is certified that error appears in the above-identified patent and that said Letters Patent is hereby corrected as shown below:

ON TITLE PAGE COLUMN 1 ITEM [30]:
Foreign Application Priority Data, "2001/317260" should read --2001-317260--.

COLUMN 1:
Line 59, "than t" should read --than the--.

COLUMN 2:
Line 62, "includes" should read --that includes--.

COLUMN 3:
Line 50, "a" should read --is a--.
Line 57, "on t" should read --on the--.
Line 64, "from t" should read --from the--; and "reads" should read --read--.
Line 65, "supplies" should read --supply--.
Line 67, "mechanical" should read --mechanically--.

COLUMN 4:
Line 8, "has a substantially" should be deleted.
Line 25, "yellow" should read --yellow (Y)--.

COLUMN 5:
Line 9, "in" should read --is in--.
Line 34, "heating roller 701 which is a" should be deleted.
Line 41, "member 101a-101s d" should read --members 10-1a-101d--.

COLUMN 6:
Line 2, "in t" should read --in the--.
Line 25, "to t" should read --the--.
Line 26, "CPU70S" should read --CPU 708--.
Line 52, "From t" should read --From the--.
Line 53, "to t" should read --to the--.
Line 54, "When t" should read --When the--.

UNITED STATES PATENT AND TRADEMARK OFFICE

CERTIFICATE OF CORRECTION

PATENT NO. : 7,026,586 B2
APPLICATION NO. : 11/071328
DATED : April 11, 2006
INVENTOR(S) : Masashi Oyumi It is certified that error appears in the above-identified patent and that said Letters Patent is hereby corrected as shown below:

COLUMN 7:
Line 4, “flown” should read --flowing--.
Line 9, “return to t” should read --returning to the--.
Line 18, “from t” should read --from the--.
Line 19, “across t” should read --across the--.
Line 27, “By t” should read --By the--.
Line 40, “on t” should read --on the--.
Line 47, “t CPU708,” should read --the CPU 708--.
Line 49, “to t” should read --to the--.
Line 50, “to t” should read --to the--.
Line 56, “b101” should read --101--.

COLUMN 8:
Line 30, “to t” should read --to the--.
Line 49, “of t” should read --of the--.
Line 50, “t” should read --the--.

Signed and Sealed this

Thirty-first Day of October, 2006

JON W. DUDAS
*Director of the United States Patent and Trademark Office*